United States Patent [19]

Kolber et al.

[11] Patent Number: 4,984,768

[45] Date of Patent: Jan. 15, 1991

[54] RETRACTABLE CHAIR

[76] Inventors: Michael A. Kolber; Terri L. Meinking, both of 5861 SW. 76th St., South Miami, Fla. 33143

[21] Appl. No.: 428,184

[22] Filed: Oct. 27, 1989

[51] Int. Cl.[5] ..... A47C 4/00

[52] U.S. Cl. ..... 257/16; 297/350; 297/383; 5/116; 5/185

[58] Field of Search ..... 297/16, 42, 235, 351, 297/252; 5/116, 185

[56] References Cited

U.S. PATENT DOCUMENTS

| | | | |
|---|---|---|---|
| 1,080,577 | 12/1913 | Pascale et al. | 5/116 X |
| 1,299,827 | 4/1919 | Edwards | 297/42 X |
| 2,667,913 | 2/1954 | Dustin | 297/252 X |
| 3,637,253 | 1/1972 | Maule et al. | 297/383 X |
| 3,759,572 | 9/1973 | Koepke | 297/458 X |
| 4,019,211 | 4/1977 | Spitz | 5/185 X |
| 4,693,204 | 9/1987 | Klein | 297/350 X |
| 4,715,650 | 12/1987 | Berman et al. | 297/350 X |
| 4,765,678 | 8/1988 | Auang | 5/185 X |

*Primary Examiner*—Peter A. Aschenbrenner
*Attorney, Agent, or Firm*—Malin, Haley, McHale, DiMaggio & Crosby

[57] ABSTRACT

A laterally retractable and longitudinally foldable chair having a plurality of transverse struts connected with a plurality of longitudinal support members to form hingedly connected sub assemblies of a chair frame for supporting an individual. Each strut is provided with adjusting means. Each adjusting means has a locking means associated therewith which allows for selective adjustment of the width of said chair between a retracted, or compact, configuration and an expanded, or in use, configuration. The adjusting means is comprised of a projection and cooperating aperture in each said transverse strut which allows one to releasably lock the chair in the expanded or retracted position as desired. The novel chair further comprises a plurality of hinge members which hingedly connect the longitudinal support members and which allow the individual sub assemblies to be folded upon themselves to futher reduce the collapsed dimensions of the chair. The hinge members are comprised of a linking means which allows for effective and unencumbered folding of the chair. The transverse struts may connect to the side rails of the chair at either the hinge points or at any intermediate point therein. The hinge members are contructed and arranged so that when the chair is expanded longitudinally they will support weight and not collapse into a folded configuration.

4 Claims, 3 Drawing Sheets

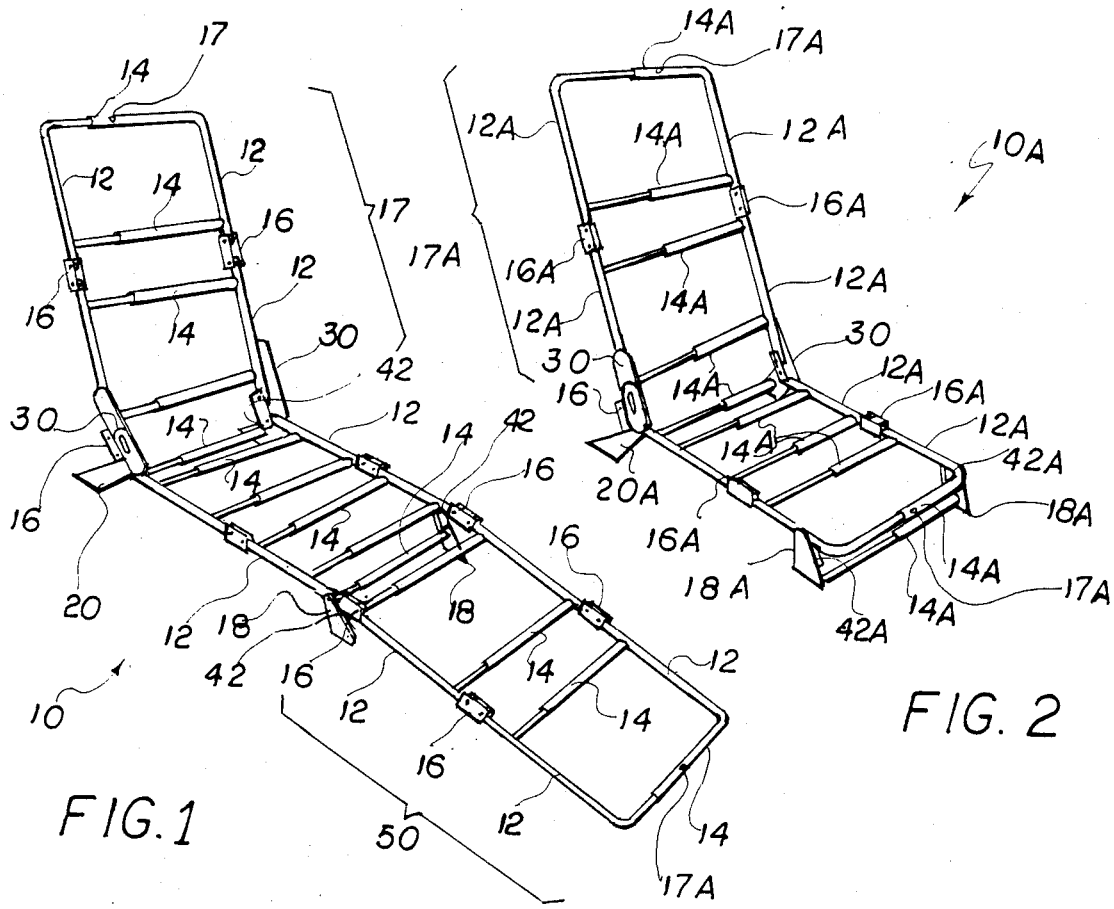
FIG. 1
FIG. 2
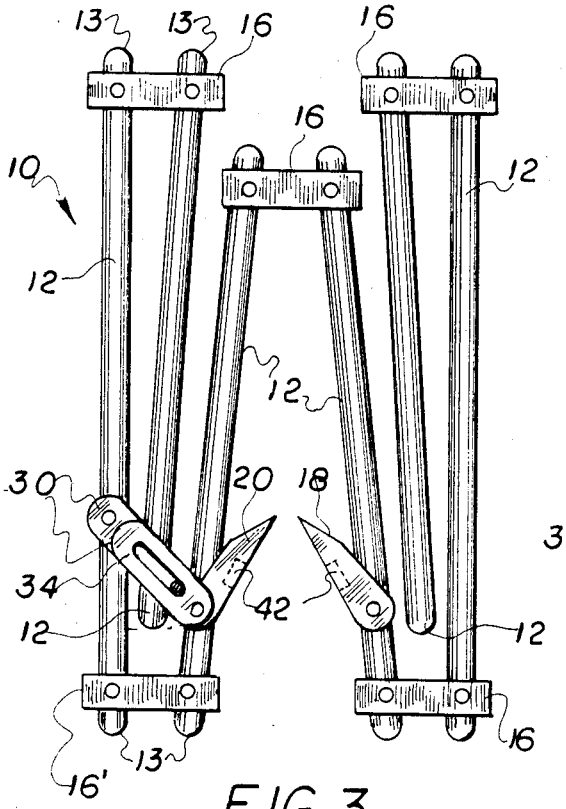
FIG. 3
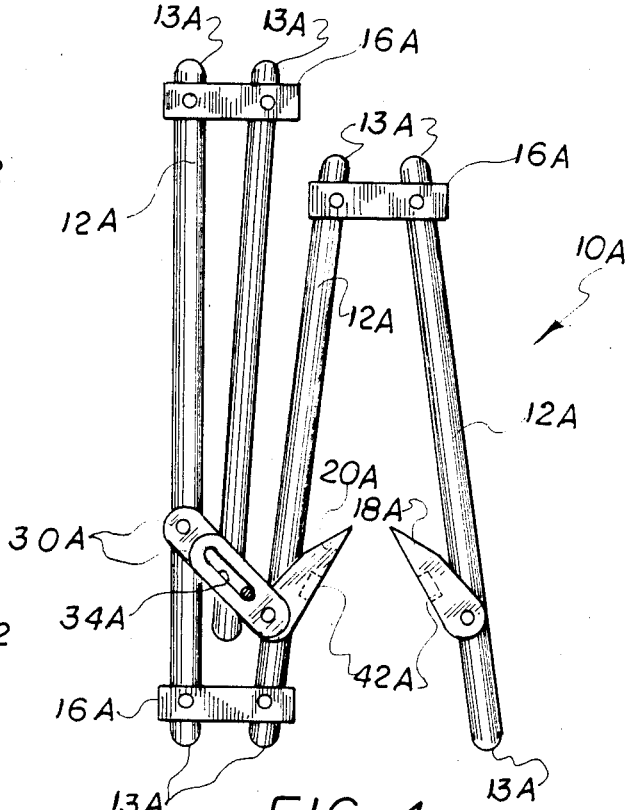
FIG. 4

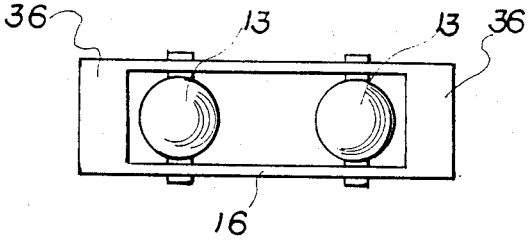
FIG. 5
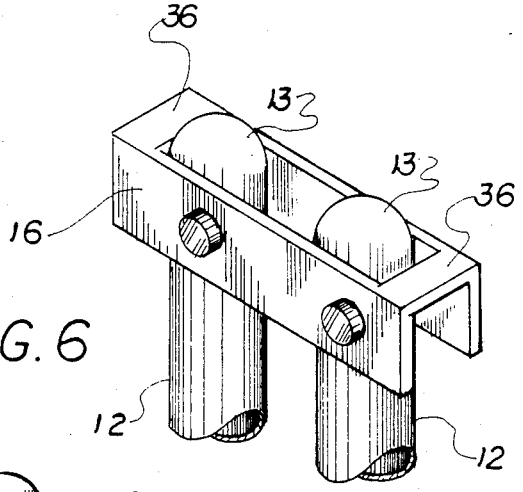
FIG. 6
FIG. 7
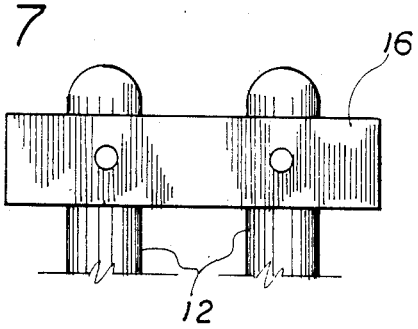
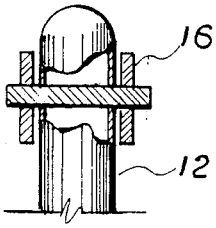
FIG. 8
FIG. 9
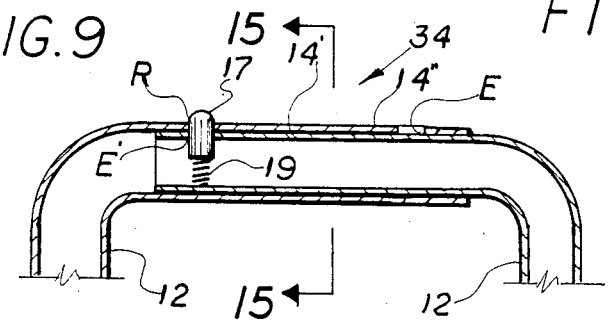
FIG. 15
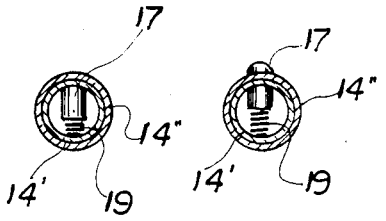
FIG. 14
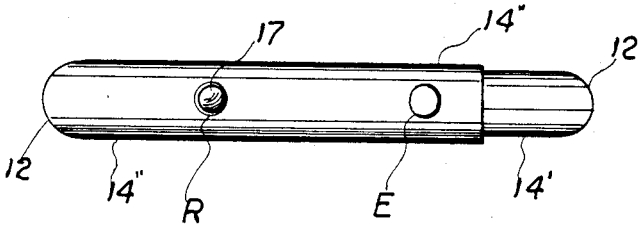
FIG. 10
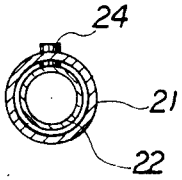
FIG. 13
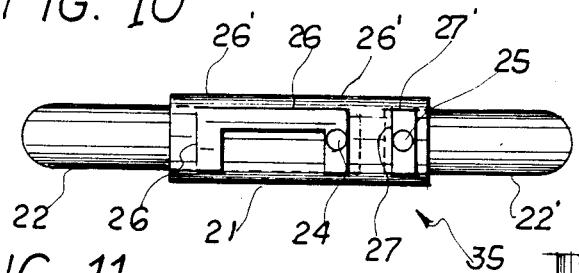
FIG. 11
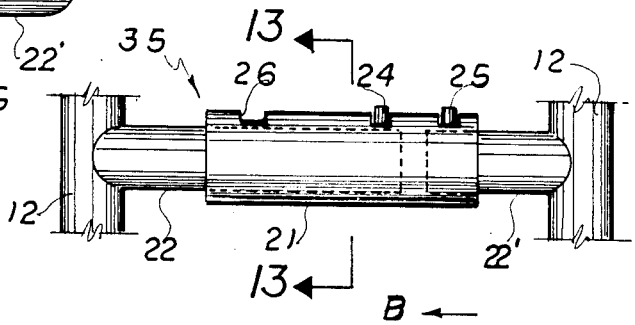
FIG. 12

RETRACTABLE CHAIR

BACKGROUND OF THE INVENTION

1. Field of the Invention

This invention relates generally to foldable furniture and in particular to a chair which is both laterally and longitudinally retractable.

2. Description of the Prior Art

Foldable chairs and the like are well known in the art for their use on porches, at the beach, or in any location where it is desirable to use furniture which can easily be folded for compact transport. Such foldable chairs generally possess either a dual or tri-longitudinal folding capability and the legs or support members collapse underneath as well. In the collapsed position, the chair is relatively flat and approximately one half or less of its extended length. The width, however, retains its original dimension.

Also known in the prior art are convertible type chairs such as shown in U.S. Pat. No. 1,530,420 to W. Schmitt, which discloses a chair which can be expanded laterally so as to form a bed or divan. The chair is comprised of two parallel side frames which are connected by a plurality of slidably interengaging bars, wherein the bars permit the frames to be pulled apart any desired distance, thereby increasing the lateral dimensions of the chair. Schmitt, however, does not address the problem of longitudinal collapsing and transport.

The retractable chair of the present invention distinguishes from the prior art by the provisions of both lateral retractability and longitudinal folding to provide a more compact unit for transport and storage. A long felt need has existed in the art for a practical chair which is full size when in its extended or in use position, and additionally takes up very little storage space when folded for transport or storage. The folding chairs of the prior art fail to retract laterally and therefore, when packed in the trunk of the typical automobile, leave very little space unaccounted for. It then becomes a problem to transport additional items. Difficulty is further incurred when attempting to store these chairs in a closet or the like which is generally already limited for space. The chair, because it does not retract laterally, must at times be stacked on top of items previously stored, creating disorganization, or alternately, requires that items be rearranged to allow for the chair(s) to be stored. Finally, the folding chairs of the prior art can be cumbersome, bulky, and difficult to carry and hold onto when being transported manually.

SUMMARY OF THE INVENTION

The present invention comprises a laterally retractable and longitudinally foldable chair having a plurality of transverse struts connected with a plurality of longitudinal support members to form a chair frame for supporting an individual. Each strut is provided with adjusting means. Each adjusting means has a locking means associated therewith which allows for selective adjustment of the width of said chair between a retracted, or compact, configuration and an expanded, or in use, configuration. Said adjusting means is comprised of a projection and cooperating aperture in each said transverse strut which allows one to releasably lock the chair in the expanded or retracted position as desired The novel chair further comprises a plurality of hinge members which hingedly connect the longitudinal support members. The hinge members are comprised of a linking means which allows for effective and unencumbered folding of the chair. The transverse struts may connect to the side rails of the chair at either the hinge points or at any intermediate point therein. The hinge members are constructed and arranged so that when the chair is expanded longitudinally they will support weight and not collapse into a folded configuration.

It is therefore an important object of the present invention to provide a chair frame having transverse members which can be retracted to reduce the lateral dimension of the chair for transport and storage.

Another object of the present invention is to provide a laterally retractable chair which can be folded longitudinally and reduced substantially in width to form a generally compacted structure.

A further object of the present invention is to provide a full size chair that can be collapsed, whereby the length, width, and depth dimensions are each significantly reduced with respect to the dimensions of the extended position Still another object of the present invention is the provision of a laterally retractable folding chair which fits more commodiously in a storage closet or the like than folding chairs heretofore available.

Other objects and advantages of the present invention will become apparent when the retractable chair of the present invention is considered in conjunction with the accompanying drawings.

BRIEF DESCRIPTION OF THE DRAWINGS

FIG. 1 is a front perspective view of the chair frame of the present invention in the fully extended position.

FIG. 2 is a front perspective view of the chair frame of the present invention in the fully extended position wherein the leg support section of FIG. 1 is not included.

FIG. 3 is a side elevational view of FIG. 1 in the folded position.

FIG. 4 is a side elevational view of FIG. 2 in the folded position.

FIG. 5 is a top plan view of a hinge member.

FIG. 6 is a front perspective view of the hinge member of FIG. 5.

FIG. 7 shows the hinge member of FIG. 6 in a side elevational view.

FIG. 8 a cross-sectional view of the hinge member of FIG. 6.

FIG. 9 shows an elevational view of a portion of the chair showing a first embodiment of a locking means in the retracted or compacted position.

FIG. 10 is a top plan view of the locking means of FIG. 9.

FIG. 11 is a plan view of a second embodiment of a locking means in the retracted position.

FIG. 12 is a front elevational view of the locking means of FIG. 11.

FIG. 13 the locking means of FIG. 11 taken in cross-section along line 13—13 of FIG. 12.

FIG. 14 is a cross-sectional view of the embodiment of FIG. 9 wherein the locking tab is in the unlocked position.

FIG. 15 is a cross-sectional view taken along lines 14—14 of FIG. 9.

DETAILED DESCRIPTION OF THE PREFERRED EMBODIMENT

Figure 16:
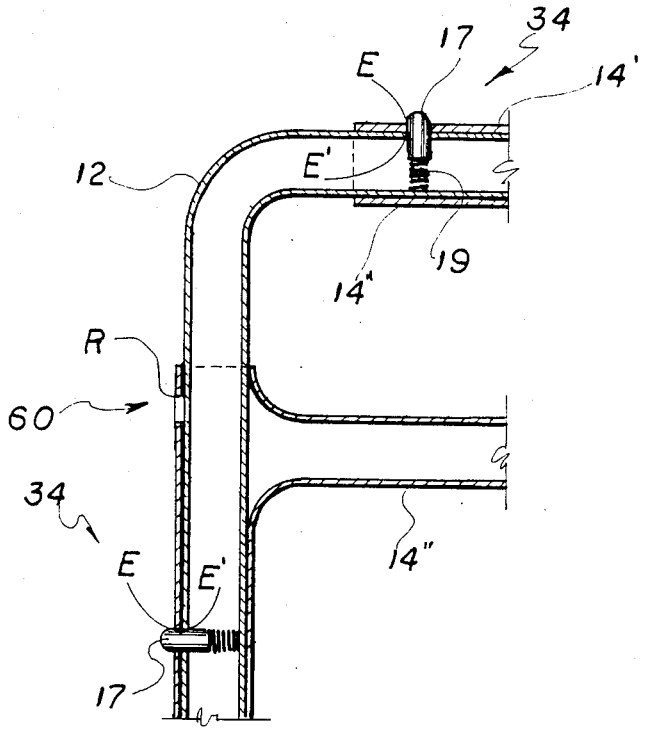
FIG. 16 is a front partial elevational view of a second embodiment of the chair of FIGS. 1 and 3.

Referring now to the drawings and in particular to FIGS. 1 and 3, there is illustrated a tubular support frame 10, preferably made from PVC, aluminum or any suitable material The upper surface of the frame 10 may be adapted to receive suitable lounge cushioning material (not shown) as is well known in the art. The frame 10 includes a plurality of hingedly connected longitudinal members 12 and a plurality of telescopingly adjustable transverse struts 14. The longitudinal members 12 are joined by hinge members 16 which in turn effect the longitudinal folding aspect of the invention. The transverse struts 14 are connected to the longitudinal frame members 12 intermediate the hinge members 16 as shown in FIGS. 1 and 2, or, in an alternative embodiment, the transverse struts 14 may connect at the hinge members 16. Also, said struts connecting legs 18 to one another and legs 20 to one another.

FIGS. 2 and 4 show an embodiment of the retractable chair of FIGS. 1 and 3 where the suffix "a" has been added to like reference numerals.

The frame 10 is held above ground level by two sets of collapsible leg support members 18 and 20. To ensure stability, in the preferred embodiment, rear leg support members 20 are angled rearward approximately 70 degrees from vertical and the front leg support members 18 are angled frontward approximately 70 degrees from vertical Front and rear leg support members 18 and 20, respectively, are constrained from movement beyond a predetermined position by stop members 42 and 42*a* in FIGS. 1–4, respectively. Said stop members 42 and 42*a* are rigidly affixed to leg members 18, 18*a* and 20, 20*a*, respectively, and come into abutting engagement with the underside of hinge 16 to prevent movement of legs 18 and 18*a* beyond the approximately 70 degree-from-vertical position shown in FIGS. 1 and 2 and consequent collapse of the support device.

Slot 34 of brackets 30 allow the chair back to be folded down and re-opened for storage or use.

In the embodiment shown in FIGS. 1 and 3, a chaise lounge chair is provided by the inclusion of a foot rest portion 50. FIGS. 2 and 4 depict a second embodiment identical in all respects to that of FIGS. 1 and 3 except that leg support portion 50 is excluded The hinging feature of frame 10 can be accomplished by any position restricting hinge, although in the preferred embodiment a dual pin-type hinge member with a link 16 best shown in FIGS. 5–8, is utilized The pin-type hinge 16 connects the terminal ends 13 of two adjacent longitudinal struts 12 to each other. The hinge 16 comprises a stop means 36 which cooperate with the ends of both strut members 12 to preclude movement of the longitudinal struts 12 beyond the horizontal, in use or unfolded, position shown in FIGS. 1 and 2.

Perhaps the most novel aspect of the present invention is the provision of means for laterally retracting the transverse struts 14 to provide a highly compact unit for storage. In the first embodiment best illustrated in FIGS. 9, 10, 14 and 15, each transverse strut member 14 is comprised of two telescoping sections 14′ and 14″. First strut section 14′ is disposed in telescoping relation within second strut section 14″, section 14″ having a slightly larger inside diameter than the outside diameter of the first strut section 14′, thereby creating a telescoping assembly.

To effectuate extension and retraction of the strut assemblies, a locking means 34 is provided comprising a spring actuated button 17 which is movable into and out of registry with aligned apertures disposed through both sections 14′ and 14″. Second strut section 14″ is provided with two non-aligned apertures E and R. First strut section 14′ is provided with a single aperture E, A button 17, which is biased by compression spring 19, projects through aperture E′ of the first strut section 14′ and R of the second strut section 14″ as shown in FIG. 9, thereby precluding any relative movement between strut sections 14, 14″ and locking the transverse strut 14 in a retracted position. All strut assemblies must be simultaneously adjusted to assume either the retracted or extended positions. To move the chair into the extended position, the button 17 on each transverse strut 14 is depressed (FIG. 14) so that the top thereof clears the aligned apertures of the first and second strut sections. First strut section 14′ is drawn partially out of the second strut section 14″ until apertures E and E, are aligned, allowing button 17 to protrude therethrough, consequently locking strut 14 in an extended position.

In the preferred embodiment, only two of the strut members 14 need have locking means 34 associated therewith as no more than two hands are necessary for actuation thereof and collapsing of the chair.

In a second embodiment for the retracting and locking means 35 (shown in FIGS. 11–13), the transverse strut members are comprised of a sleeve member 21 slidingly associated with strut end segments 22 and 22′. Strut sections 22, 22′ are provided with identical diameters and do not telescope within one another. A sleeve 21 is provided with slots 26 and 27 wherein the sleeve 21, having a larger diameter than the strut sections 22 and 22′, fully encompasses the terminal adjacent ends of the strut sections 22 and 22′. The first strut section 22 is provided with an integrally connected first tab 24 and the second strut section 22′ is provided with an integrally connected second tab 25. FIG. 11 shows the locking means 35 disposed in a retracted position. Tab 24 is receivably held within U-shaped slot 26 To achieve expansion of the transverse strut 22/22′, sleeve 21 is rotated to cause tabs 24 and 25 to travel along slots 26 and 27, respectively, in the direction toward the arrow A in FIG. 11. When the sleeve 21 cannot be rotated any further due to tabs 24 and 25 contacting stop areas 26′ and 27′ of sleeve 21, the first strut section 22 is drawn outward relative to section 22′ (in the direction of arrow B) allowing travel of tab 24 along slot 26. Sleeve 21 is thereafter rotated, this time in the reverse direction to that previously leaving tab 25 at the left-most segment of slot 26. In the extended position sleeve 21 becomes primarily hollow as a portion of first strut section 22 has been withdrawn therefrom. Slot 27 and second tab 25 provide a means for retaining first strut section 22′ in operative association with sleeve 21 at all times.

FIG. 16 depicts an optional headrest and footrest retraction assembly 60 which can be incorporated into the tubular support frame in the manner disclosed in FIGS. 9, 10, 14 and 15. The height of the headrest portion can be adjusted up and down as desired by a user of the device.

As best seen in the alternative embodiment of FIG. 16, the foot support means 50 of FIGS. 1 and 3 may be retractable and extendable by actuation of locking means 34 in like manner to that described previously for locking means 34 as shown in FIGS. 9, 10, 14 and 15.

The instant invention has been described herein in what is considered to be the most practical and preferred embodiment. Various modifications are possible and may obviously be resorted to by those skilled in the art without departing from the spirit and scope of the invention, as hereinafter defined by the claims hereof, as only a preferred embodiment has.

What is claimed is:

1. An expandable and retractable chair comprised of:

a foldable chair sub frame comprised of a plurality of rectangularly interconnected transverse and longitudinal strut sub assemblies, one sub assembly hingedly connected to the other by hinge means;

leg means hingedly connected to said chair sub frame for supporting same above a support surface;

said transverse struts being selectively telescopingly extendable or retractable to thereby selectively increase or decrease the width of the chair;

wherein the transverse struts are each comprised of a pair of telescopingly slideable sleeve members having a cooperating locking means for locking said telescoping sleeve members against relative movement with each other in a first, retracted position or alternatively in a second, expanded position;

wherein said locking means is comprised of a spring biased tab adapted to be received by aligned apertures defined by said sleeve members of said transverse strut, said spring biased tab being normally biased into a position partially within said aligned apertures by a coil spring, said coil spring being located entirely within said sleeve members.

2. An expandable and retractable chair comprised of:

a foldable chair sub frame comprised of a plurality of rectangularly interconnected transverse and longitudinal strut sub assemblies, one sub assembly hingedly connected to the other by hinge means;

leg means hingedly connected to said chair sub frame for supporting same above a support surface;

said transverse struts being selectably telescopingly extendable or retractable to thereby selectively increase or decrease the width of the chair;

wherein said transverse struts are each comprised of a pair of telescopingly slideable sleeve members having a cooperating locking means for locking said telescoping sleeve members against relative movement with each other in a first, retracted position or alternatively in a second, expanded position;

said locking means being comprised of a sleeve member rotatably associated with a left strut segment and a right strut segment, said left strut segment being generally longer than said right strut segment, said sleeve being rotatably associated and coaxial with said left and right strut segments and telescopingly associated with said left strut segment, said sleeve having a pair of slots therein, a first slot being generally U shaped, and a second slot being spaced from said first slot, and first and second tab members, said first tab member being integrally connected with said first strut segment and slideable within said first slot, said second tab member being integrally connected with said second strut segment and operatively slideable within said second slot means.

3. The extendable and retractable chair of claim 2, wherein said chair is comprised of 14 transverse strut members and 6 transverse and longitudinal strut sub assembly arrangements hingedly interconnected to allow for accordion-like folding of said chair and to further allow for a reduction of the width thereof.

4. A collapsible beach lounge chair, comprising: a chair sub frame comprised of a left frame rail and a right frame rail in spaced relationship to one another, said left and right frame rails being connected by a plurality of telescopingly expandable and retractable transverse strut members; said transverse strut members being movable between a closed, retracted position and an open, expanded position, movement from said closed position to said open position causing a consequent increase in the width of said chair; said transverse and longituidnal struts forming a pluraliyt of discrete sub assemblies being hingedly connected one to the other to allow said chair to be folded up in accordion-like fashion, wherein said chair is collapsible both in width and length to assume a closed position to significantly decrease the size of the chair for compact storage and transport;

each said discrete sub assemblies defining a body supporting panel, each said body supporting panel being hinged so as to be foldable upon itself to effectuate a further reduction in size of said chair when collapsed.

* * * * *